US010534302B2

(12) United States Patent
Sakamoto et al.

(10) Patent No.: US 10,534,302 B2
(45) Date of Patent: Jan. 14, 2020

(54) IMAGE FORMING APPARATUS

(71) Applicant: CANON KABUSHIKI KAISHA, Tokyo (JP)

(72) Inventors: Yusuke Sakamoto, Kawasaki (JP); Satoshi Shimizu, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 120 days.

(21) Appl. No.: 15/583,320

(22) Filed: May 1, 2017

(65) Prior Publication Data

US 2017/0329269 A1 Nov. 16, 2017

(30) Foreign Application Priority Data

May 11, 2016 (JP) ..... 2016-095269

(51) Int. Cl.

| | |
|---|---|
| ***B65H 7/00*** | (2006.01) |
| ***G03G 21/14*** | (2006.01) |
| ***G03G 15/00*** | (2006.01) |
| ***G03G 15/16*** | (2006.01) |

(52) U.S. Cl.

CPC ..... *G03G 15/6529* (2013.01); *G03G 15/161* (2013.01); *G03G 15/6564* (2013.01); *G03G 15/505* (2013.01); *G03G 15/6591* (2013.01); *G03G 2215/00742* (2013.01)

(58) Field of Classification Search

CPC ..... G03G 15/161; G03G 15/505; G03G 15/6529; G03G 15/6564; G03G 15/6591; G03G 2215/00742

See application file for complete search history.

(56) References Cited

U.S. PATENT DOCUMENTS 6,519,443 B1 * 2/2003 Coriale ..... B65H 5/34 399/388
6,533,263 B2 * 3/2003 Tamura ..... B65H 7/18 271/10.01

(Continued)

FOREIGN PATENT DOCUMENTS

JP 2014035379 A 2/2014
JP 2014041296 A 3/2014

(Continued)

*Primary Examiner* — Judy Nguyen
*Assistant Examiner* — Marissa Ferguson-Samreth
(74) *Attorney, Agent, or Firm* — Canon U.S.A., Inc. IP Division

(57) ABSTRACT

An image forming apparatus includes an image bearing member and transfer and control units. The transfer unit and image bearing member form a nip portion where a recording material receives a toner image. The control unit controls image formation based on a timing when a recording material leading edge is detected. To perform sheet conveyance, the control unit changes a first recording material conveyance speed to a second speed before a fed first recording material leading edge is detected. Before the first recording material leading edge reaches the nip portion, the control unit changes the first recording material conveyance speed to a first speed, slower than the second speed, based on when the fed first recording material leading edge is detected. The control unit obtains a timing for the image formation to the image bearing member based on when the conveyance speed is changed from the faster to slower speed.

6 Claims, 12 Drawing Sheets

(56) References Cited

U.S. PATENT DOCUMENTS

| | | | | |
|---|---|---|---|---|
| 8,391,749 | B2 * | 3/2013 | Inoue | G03G 21/08 399/128 |
| 2003/0054639 | A1 * | 3/2003 | Deliwala | B82Y 20/00 438/689 |
| 2010/0148431 | A1 * | 6/2010 | Otsuka | B65H 5/062 271/265.01 |
| 2011/0175281 | A1 * | 7/2011 | Takahashi | G03G 15/6564 271/227 |
| 2012/0014731 | A1 * | 1/2012 | Yasui | B65H 3/44 399/396 |
| 2012/0027426 | A1 * | 2/2012 | Maruta | G03G 15/6564 399/16 |
| 2014/0042693 | A1 * | 2/2014 | Endo | B65H 7/08 271/270 |
| 2015/0261160 | A1 * | 9/2015 | Sato | B65H 7/02 399/396 |

FOREIGN PATENT DOCUMENTS

| | | | |
|---|---|---|---|
| JP | 201514694 | A | 1/2015 |
| JP | 2016199395 | A | 12/2016 |

* cited by examiner

IMAGE FORMING APPARATUS

BACKGROUND OF THE INVENTION

Field of the Invention

The present disclosure relates to an image forming apparatus such as a printer, a copier, a recording device, or a facsimile.

Description of the Related Art

In recent years, a demand for slowing down a process speed in image formation with respect to a recording sheet has existed to suppress operation sound generated from an image forming apparatus. On the other hand, when the process speed is decreased, a throughput in related art is not achieved. However, when a sheet interval is shortened, since the process speed can be decreased while the throughput is maintained, deliberation has been made to shorten the sheet interval. The sheet interval refers to a distance from a trailing edge of a preceding sheet to a leading edge of a succeeding sheet when images are continuously formed on a plurality of recording sheets.

For example, a configuration has been proposed in which a conveyance malfunction is avoided by performing acceleration and deceleration of a conveyance speed of the recording sheet in a section from a top sensor arranged on an upstream side in a conveyance direction with respect to a transfer part to the transfer part (for example, see Japanese Patent Laid-Open No. 2014-035379). In addition, a configuration has been proposed in which a section where the acceleration and deceleration can be performed is lengthened by adding a sensor on the upstream side in the conveyance direction with respect to the top sensor (for example, see Japanese Patent Laid-Open No. 2014-041296).

However, according to the configuration in which the top sensor is arranged on the upstream side with respect to the transfer part, and the conveyance speed of the recording sheet is accelerated in accordance with a timing when the recording sheet is detected by the top sensor, the section where the conveyance speed of the recording sheet can be accelerated is limited to the section from the sensor to the transfer part. For this reason, in a case where the sheet interval is further shortened, a motor needs to be driven at a further faster speed. For this reason, increase in the operation sound or used torque of the motor becomes an issue. In addition, according to the configuration in which the sensor is arranged on the upstream side with respect to the top sensor, a sensor different from the top sensor is added, and increase in costs becomes an issue.

SUMMARY OF THE INVENTION

The information in the present disclosure works towards reducing operation sound or used torque of a motor without adding a new sensor.

According to an aspect of the present invention, an image forming apparatus includes an image bearing member, a transfer unit configured to form a nip portion together with the image bearing member and transfer a toner image formed on the image bearing member to a recording material in the nip portion, a feeding unit configured to feed a recording material stacked in an accommodation portion to a conveyance path, a conveyance unit that is arranged along the conveyance path and configured to convey the recording material fed by the feeding unit, a first driving unit configured to drive the feeding unit and the conveyance unit, a detection unit that is arranged between the conveyance unit and the transfer unit and configured to detect the recording material, and a control unit configured to control in a manner that image formation to the image bearing member is started based on a timing when a leading edge of the recording material is detected by the detection unit, wherein the control unit changes a conveyance speed of a first recording material from a first speed to a second speed, that is faster than the first speed, before a leading edge of the first recording material fed by the feeding unit is detected by the detection unit to perform conveyance by the conveyance unit, controls the first driving unit in a manner that the conveyance speed of the first recording material is changed from the second speed to the first speed before the leading edge of the first recording material reaches the nip portion based on a timing when the leading edge of the first recording material is detected by the detection unit, and obtains a timing for the image formation to the image bearing member based on a timing when the conveyance speed is changed from the second speed to the first speed.

Further features will become apparent from the following description of embodiments with reference to the attached drawings.

DESCRIPTION OF THE EMBODIMENTS

Hereinafter, embodiments will be described in detail with reference to the drawings.

First Embodiment

Image Forming Apparatus

Figure 1A:
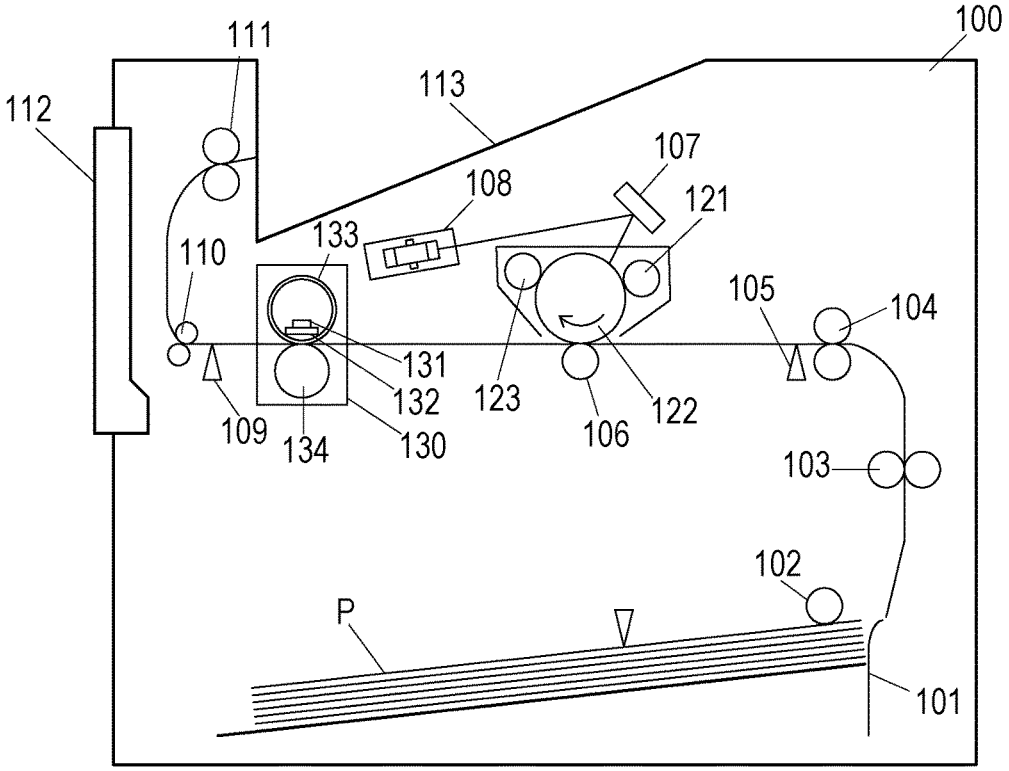
FIG. 1A illustrates an image forming apparatus according to first and second embodiments.

FIG. 1A is a schematic cross sectional view illustrating an image forming apparatus 100 functioning as a printer of an electrophotographic method. A photosensitive drum 122 is, for example, an organic photosensitive or amorphous silicon photosensitive image bearing member and rotates in a direction of an arrow in the drawing (clockwise direction) at a predetermined circumferential velocity (process speed) Vd. A charging roller 123 charges a circumferential surface of the photosensitive drum 122 to have a uniform potential. An optical box 108 irradiates the circumferential surface of the photosensitive drum 122 with laser light modulated in accordance with image information input from an image signal generation apparatus such as an image reading apparatus or a computer via a mirror 107. As a result, an electrostatic latent image corresponding to the image information is formed. An exposure starting timing in a sub scanning direction corresponding to a rotation direction of the photosensitive drum 122 is determined by a sub scanning synchronization signal. The optical box 108 functions as an image forming unit configured to form an image on the photosensitive drum 122 using the synchronization signal as a starting point. A development roller 121 develops the electrostatic latent image by using toner to form a toner image.

A feeding roller 102 functioning as a feeding unit supplies sheets P corresponding to recording media stacked on a sheet cassette 101 to a conveyance path one by one. The sheet cassette 101, a manual feed tray which is not illustrated in the drawing, or the like functions as an accommodation portion that accommodates the sheets P to be supplied to the conveyance path. Conveyance rollers 103 and registration rollers 104 further convey the sheet P to a downstream side of the conveyance direction. The conveyance rollers 103 and the registration rollers 104 are examples of conveyance units configured to convey the sheet P from the sheet cassette 101 to a transfer roller 106 functioning as a transfer unit. In addition, the registration rollers 104 is a conveyance unit arranged so as to be closest to the transfer roller 106 among the conveyance units. That is, the registration rollers 104 are rollers located on the most downstream side among the conveyance units on an upstream side in a conveyance direction of the sheet P with respect to the transfer roller 106. On the other hand, the conveyance rollers 103 are located on the most upstream side in the conveyance direction of the sheet P among the conveyance units.

A top sensor 105 functioning as a detection unit configured to detect the sheet P is arranged in a section on a conveyance path from the registration rollers 104 to the transfer roller 106 (hereinafter, which will be referred to as a conveyance section). The top sensor 105 is arranged on the upstream side in the conveyance direction of the sheet P with respect to the transfer roller 106 (hereinafter, which will be referred to as the upstream side). The conveyance rollers 103 and the registration rollers 104 are arranged on the upstream side with respect to the transfer roller 106. When the sheet P passes through a nip portion formed by the photosensitive drum 122 and the transfer roller 106 (hereinafter, which will be referred to as transfer nip portion), the toner image is transferred from the photosensitive drum 122 to the sheet P. A transfer unit such as the transfer roller 106 (transfer blade depending on the image forming apparatus) functions as a transfer unit configured to transfer the toner image formed by the photosensitive drum 122 to the sheet P.

A fixing apparatus 130 is provided with a thermistor 131, a heater 132, a fixing film 133, and a pressurizing roller 134. The fixing apparatus 130 maintains a certain temperature of the heater 132 based on a temperature detected by the thermistor 131. The toner image is fixed onto the sheet P by the fixing film 133 and the pressurizing roller 134. When the sheet P in which the fixing processing is ended is detected by a sheet discharge sensor 109, the sheet P is discharged to a tray 112 or a tray 113. It should be noted that the tray 112 is closed as illustrated in FIG. 1A in a case where the tray 112 is not used, and the tray 112 is pivoted by using a lower edge in the drawing as an axis and opened in a case where the tray 112 is used. In a case where the sheet P is discharged to the tray 112, the sheet P is discharged by the roller 110 onto the tray 112 in a state in which the surface on which the image is formed faces up. On the other hand, in a case where the sheet P is discharged to the tray 113, the sheet P is discharged by the roller 111 onto the tray 113 in a state in which the surface on which the image is formed faces down.

Relationships Among the Respective Rollers and Motors

Figure 1B:
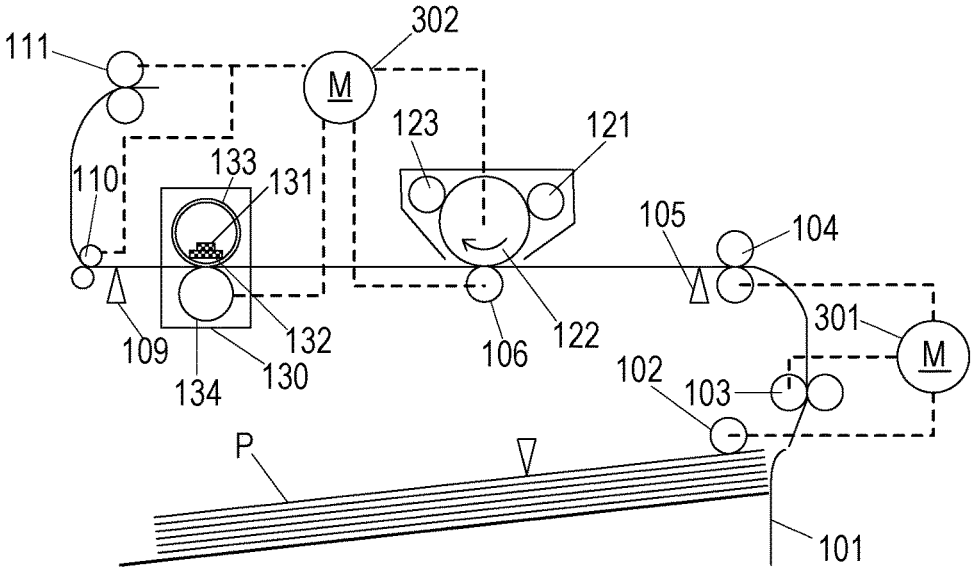
FIG. 1B illustrates relationships among respective rollers and respective motors.

FIG. 1B illustrates relationships among the respective rollers of the image forming apparatus 100 and the respective motors configured to drive the respective rollers and illustrates main parts of the image forming apparatus 100 illustrated in FIG. 1A. A conveyance motor 301 and a fixing motor 302 are used in the image forming apparatus 100. The conveyance motor 301 drives the feeding roller 102, the conveyance rollers 103, and the registration rollers 104. The conveyance motor 301 functions as a first driving unit configured to drive the conveyance unit. The fixing motor 302 functioning as a second driving unit drives the photosensitive drum 122, the transfer roller 106, the pressurizing roller 134, the roller 110, and the roller 111. According to the present embodiment, the different motors are provided as described above. A stepping motor is used as the conveyance motor 301, for example.

Block Diagram Illustrating a Control System of the Image Forming Apparatus

Figure 2A:
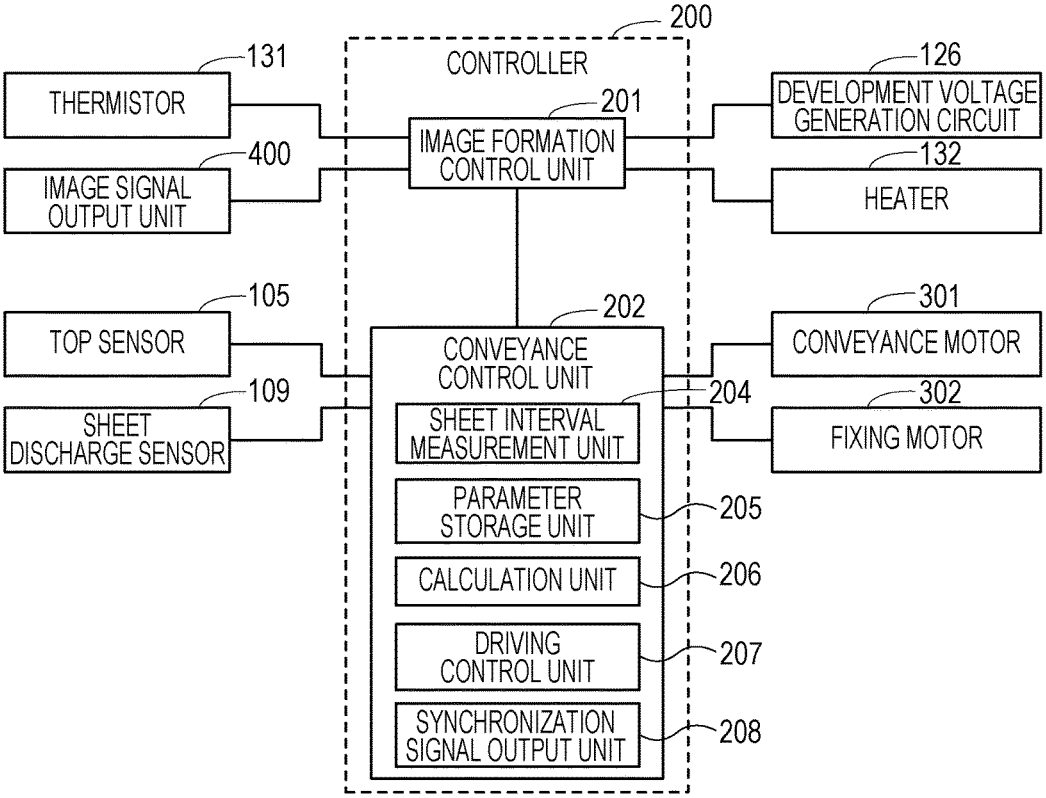
FIG. 2A is a block diagram illustrating a control system according to the first embodiment and FIG. 2B illustrates a distance relationship among members on a conveyance path according to the first and second embodiments.

FIG. 2A is a block diagram illustrating a control system according to the present embodiment. A controller 200 includes an image formation control unit 201 and a conveyance control unit 202. The controller 200 is constituted by a microprocessor configured to control the entirety of the image forming apparatus 100 in an overall manner, a ROM that stores a control program, a RAM that stores data and the like, gate elements, and the like.

To form and fix an image onto the sheet P, the image formation control unit 201 controls a development voltage generation circuit 126, the heater 132, and an image signal output unit 400. The development voltage generation circuit 126 generates a development voltage applied to the development roller 121. The image signal output unit 400 outputs an image signal to the optical box 108 by using the sub scanning synchronization signal output from the image formation control unit 201 as a starting point. The sub scanning synchronization signal is generated by the conveyance control unit 202 and output to the image signal output unit 400 via the image formation control unit 201. The optical box 108 controls on and off of the laser in accordance with the image signal.

The conveyance control unit 202 monitors the detection signal of the top sensor 105 to determine an output timing of the sub scanning synchronization signal and control driving of the conveyance motor 301 and the fixing motor 302. The detection signal of the top sensor 105 indicates whether or not the sheet P has passed, that is, indicates a sheet present state or a sheet absent state. When the detection signal is changed from the "sheet absent state" to the "sheet present state", the conveyance control unit 202 recognizes that a leading edge of the sheet P has arrived. On the other hand, when the detection signal is changed from the "sheet present state" to the "sheet absent state", the conveyance control unit 202 recognizes that a trailing edge of the sheet P has passed.

In a case where the plurality of sheets P are continuously conveyed on the conveyance path, a predetermined sheet P is set as a preceding sheet, and the sheet P that is subsequently to be conveyed (or being conveyed) after the preceding sheet is set as a succeeding sheet. The sheets continuously conveyed are assigned with reference symbols such as P1, P2, P3, and the like. The preceding sheet P1 is a sheet that is fed immediately before among the fed sheets preceding the succeeding sheet P2. A sheet interval measurement unit 204 measures an actual sheet interval that is a conveyance interval from the trailing edge of the preceding sheet P1 corresponding to a second recording material to the leading edge of the succeeding sheet P2 corresponding to a first recording material by using the detection signal from the top sensor 105. A parameter storage unit 205 stores data such as parameters used for a calculation unit 206 to perform calculation and a conveyance speed used by a driving control unit 207. The parameters include, for example, the conveyance speed determined by performances of the conveyance motor 301, an ascending time Taa, a descending time Tda, and the like. The ascending time Taa is a time used for accelerating the conveyance speed from a first speed, for example, a first speed Vp1 at which the image is formed on the photosensitive drum 122, to a second speed Vp2, for example, a speed after the acceleration for improving productivity. The descending time Tda is a time used for decelerating the conveyance speed from Vp2 to Vp1.

The calculation unit 206 executes various calculations based on various numeric expressions which will be described below. The driving control unit 207 controls the conveyance motor 301 and the fixing motor 302 in accordance with the timing and the conveyance speed determined by the calculation unit 206. For example, the driving control unit 207 can change the number of rotations of the conveyance motor 301 by changing a cycle of a clock.

A synchronization signal output unit 208 outputs the sub scanning synchronization signal to the image formation control unit 201 at a timing when a predetermined time (time Ttop which will be described below) elapses from a timing when the top sensor 105 detects the leading edge of the sheet P. Since the output of the sub scanning synchronization signal and the light emission of the laser light are started, the image is formed on the photosensitive drum 122 in a manner that the image is transferred from 0 mm at the leading edge of the sheet P. That is, the timing when the time Ttop has elapsed from the timing when the top sensor 105 detects the leading edge of the sheet P is the timing for the start of the image formation. The conveyance control unit 202 starts the feeding of the succeeding sheet P2 at the timing when the top sensor 105 detects the trailing edge of the preceding sheet P1.

Distance Relationships Among the Members on the Conveyance Path

Figure 2B:
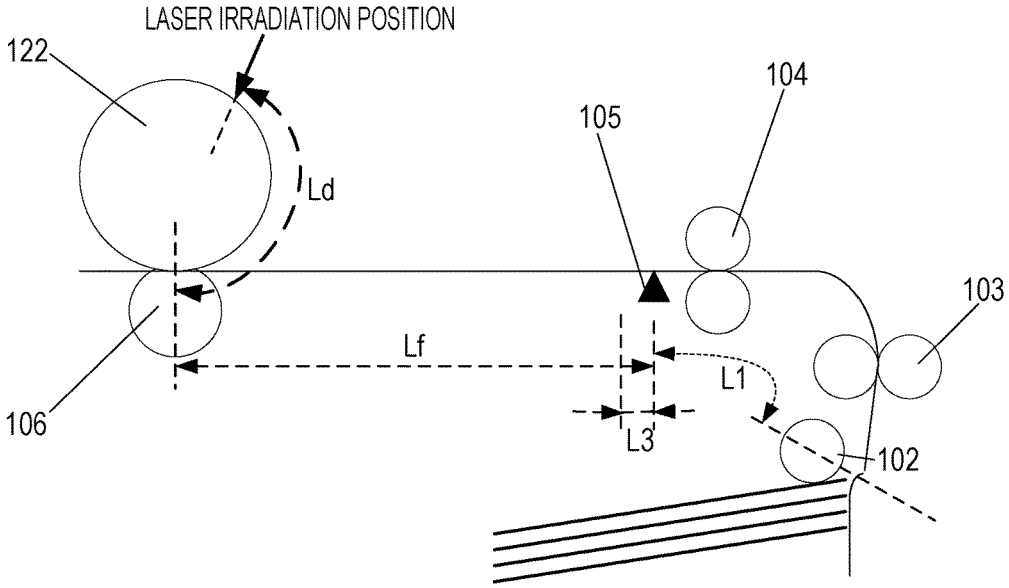

The time Ttop extending from the timing when the top sensor 105 detects the leading edge of the sheet P until the sub scanning synchronization signal is output will be described with reference to FIG. 2B. It is supposed that the sheet P is conveyed at the certain conveyance speed (Vp1). As illustrated in FIG. 2B, a distance along the surface of the photosensitive drum 122 from the laser irradiation position on the photosensitive drum 122 to the transfer nip portion (hereinafter, which will be referred to as a creepage distance) is set as Ld. A distance along the conveyance path from the top sensor 105 to the transfer nip portion is set as Lf. The certain conveyance speed (Vp1) of the sheet P is matched with the circumferential velocity Vd of the photosensitive drum 122. Therefore, the image formation on the photosensitive drum 122 may be started when the sheet P proceeds from the top sensor 105 by a distance corresponding to (Lf−Ld). That is, a time Ttop1 extending from a timing t1 when the leading edge of the sheet P is detected by the top sensor 105 to a timing t3 when the image formation on the photosensitive drum 122 is started can be represented by the following expression (1). It should be noted that the timing t3 also is a timing when the synchronization signal output unit 208 outputs the sub scanning synchronization signal. The time Ttop1 is a time using a timing when the leading edge of the sheet P has reached the top sensor 105 as a starting point.

$$Ttop1=(Lf-Ld)/Vd \quad (1)$$

It should be noted that the top sensor 105 is arranged in a manner that the distance Lf is set to be longer than the distance Ld (Lf>Ld). It should be noted that a distance L1 is set as a distance from the feeding roller 102 to the top sensor 105, and a distance L3 is set as a sheet interval corresponding to a target set for the preceding sheet P1 and the succeeding sheet P2. Details of the distances L1 and L3 will be described below.

Conveyance Control of the Sheet

Figure 3:
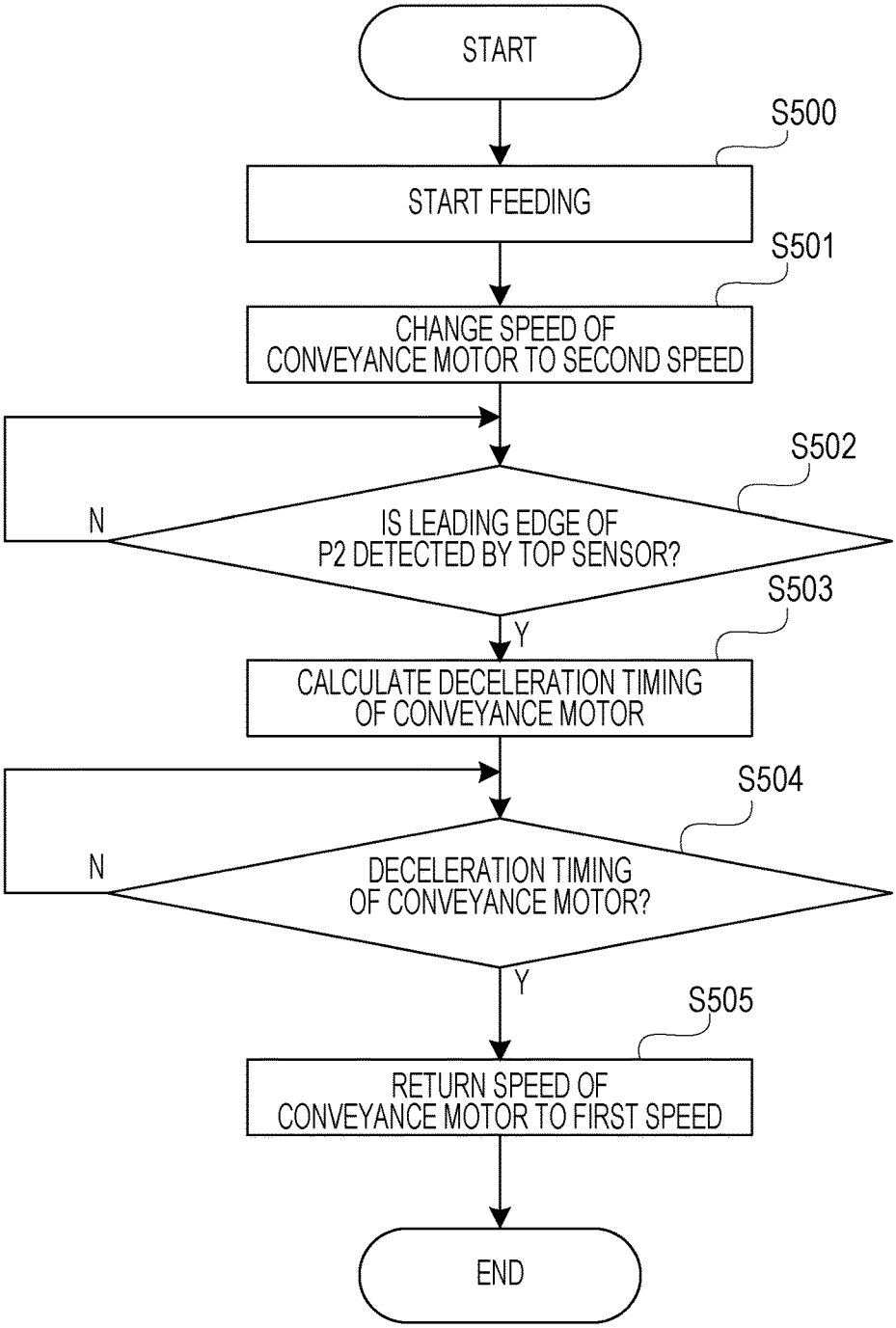
FIG. 3 is a flow chart illustrating conveyance control according to the first embodiment.
Figure 4A:
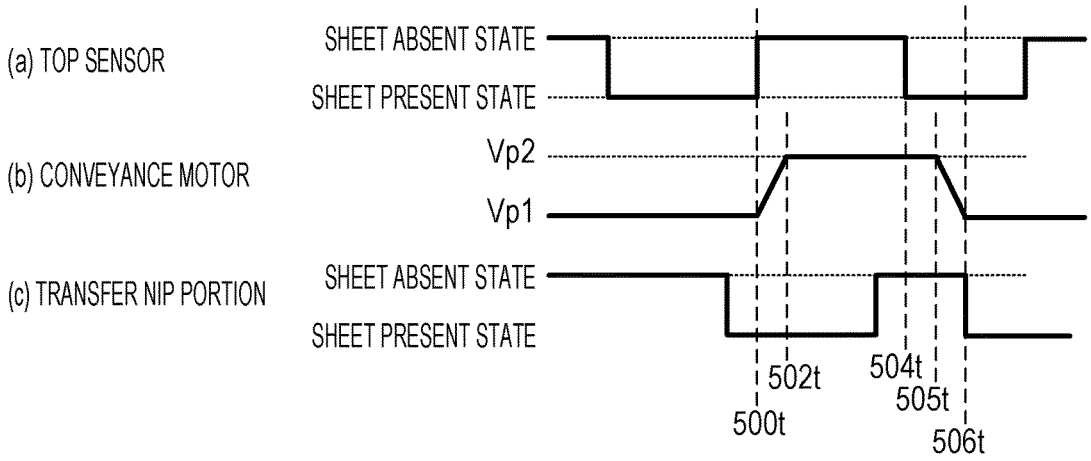
FIGS. 4A to 4C are timing charts illustrating the conveyance control according to the first embodiment.
Figure 4B:
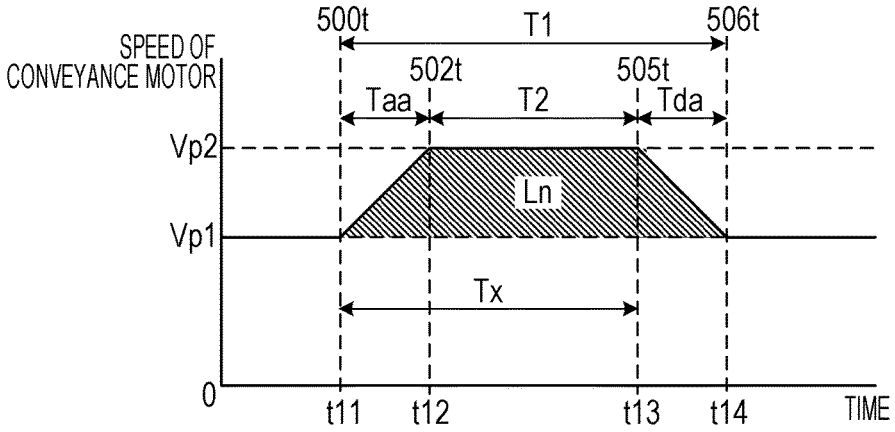
Figure 4C:
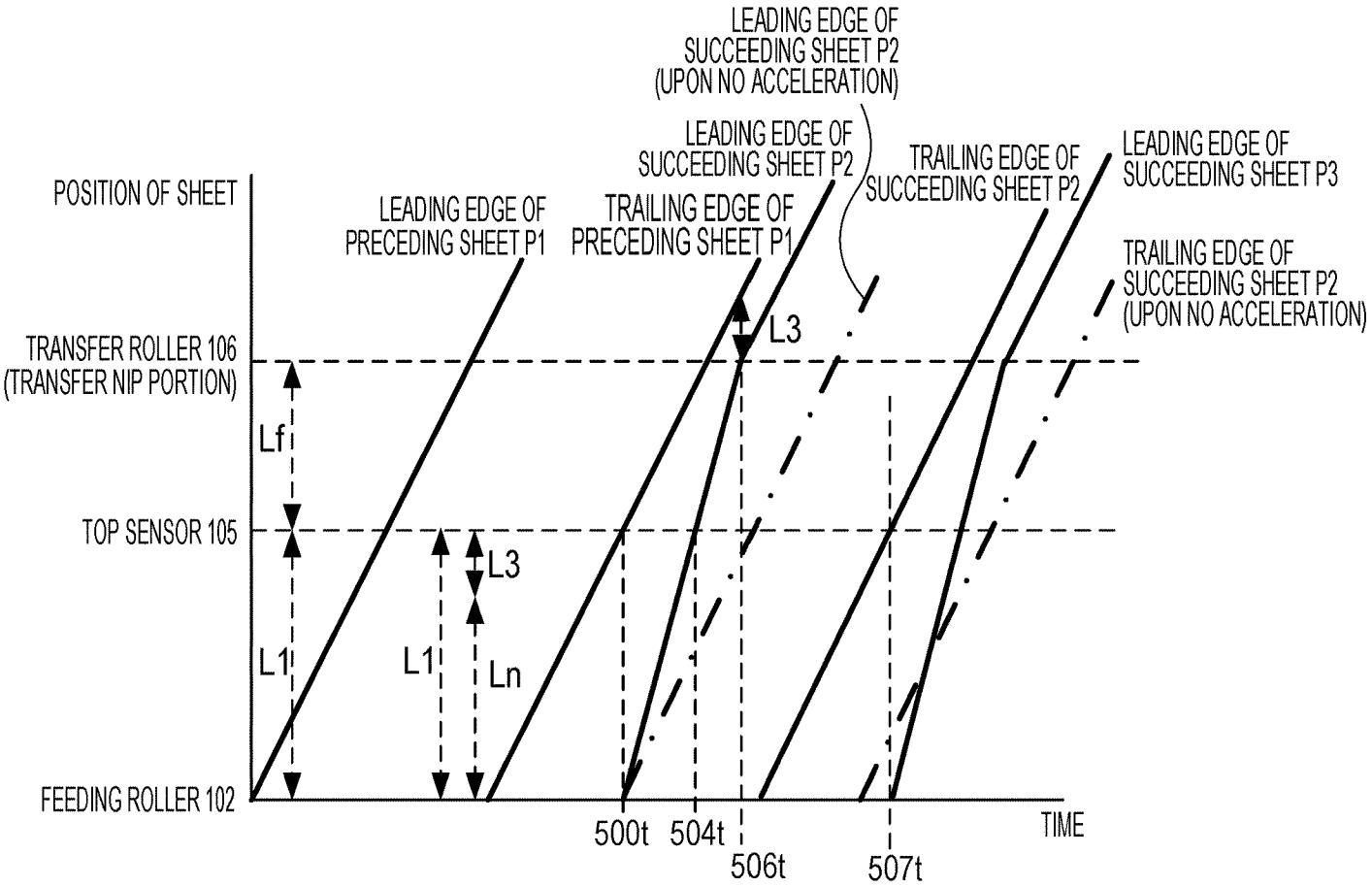

Conveyance control of the sheet P according to the present embodiment will be described in detail with reference to a flow chart illustrated in FIG. 3 and timing charts of FIGS. 4A to 4C. FIG. 3 illustrates processing executed by the controller 200 in accordance with the control program. FIG. 4A is the timing chart when the processing of the flow chart of FIG. 3 is executed. In FIG. 4A, (a) illustrates the detection signal of the top sensor 105 (the sheet present state, the sheet absent state), (b) illustrates the speed of the conveyance motor 301 (Vp1, Vp2), and (c) illustrates the sheet present state and the sheet absent state in the transfer nip portion. FIG. 4B is a timing chart that describes an operation of the conveyance motor 301 illustrated in (b) of FIG. 4A in detail where the horizontal axis represents the time, and the vertical axis represents the speed of the conveyance motor 301. FIG. 4C illustrates a relationship when the flow chart of FIG. 3 is executed between a position of the sheet P (the preceding sheet P1, the succeeding sheet P2, the succeeding sheet P3, or the like) and the time where the horizontal axis represents the time, and the vertical axis represents the position of the sheet P. In addition, with regard to the succeeding sheet P2, an operation in a case where the conveyance control according to the present embodiment is performed is represented by a solid line, and an operation (upon no acceleration) of the control in the related art in which the conveyance control according to the present embodiment is not performed is represented by a dashed-dotted line. FIG. 4C also illustrates the distance L1 from the feeding roller 102 to the top sensor 105 and the distance Lf from the top sensor 105 to the transfer nip portion (see FIG. 2B).

The controller 200 starts step 500 and subsequent steps (hereinafter, which will be referred to as S) of FIG. 3 at a timing 500*t* when the detection signal of the top sensor 105 is changed from the sheet present state to the sheet absent state, that is, a timing when the trailing edge of the preceding sheet P1 is detected. In S500, the controller 200 starts the feeding of the succeeding sheet P2 by the driving control unit 207 and resets a timer which is not illustrated in the drawing to start. It should be noted that the speed when the sheet P is fed does not necessarily need to be matched with the speed immediately before when the sheet P reaches the photosensitive drum 122. The speed when the sheet P is fed and the speed immediately before when the sheet P reaches the photosensitive drum 122 may be different from each other. In S501, the controller 200 changes the speed of the conveyance motor 301 from the first speed Vp1 to the second speed Vp2 by the driving control unit 207 of the conveyance control unit 202. The first speed Vp1 is matched with the circumferential velocity Vd of the photosensitive drum 122, and the second speed Vp2 is a speed faster than the circumferential velocity Vd (Vp2>Vd (=Vp1)). It should be noted that the second speed Vp2 may be a previously set certain speed or a speed dynamically adjusted such that shortening of the sheet interval can be completed before the succeeding sheet P2 reaches the transfer nip portion. In addition, the second speed Vp2 may be determined in accordance with a sheet type of the sheet P as will be described according to a second embodiment and subsequent sections.

According to the present embodiment, after the trailing edge of the preceding sheet P1 passes through the top sensor 105, the preceding sheet P is conveyed by the photosensitive drum 122 and the transfer roller 106 which are driven by the fixing motor 302 (see FIG. 1B). The photosensitive drum 122 and the transfer roller 106 are driven by the fixing motor 302 so as to rotate at the predetermined circumferential velocity (process speed) Vd, that is, the first speed Vp1. On the other hand, the succeeding sheet P2 is conveyed by the feeding roller 102, the conveyance rollers 103, and the registration rollers 104 which are driven by the conveyance motor 301 different from the fixing motor 302. For this reason, even when the conveyance speed of the succeeding sheet P2 is changed from the first speed Vp1 to the second speed Vp2, the transfer operation of the toner image in the transfer nip portion of the preceding sheet P1 is not affected. According to the present embodiment, a state in which the trailing edge of the preceding sheet P1 has passed through the top sensor 105 means that the preceding sheet P1 has passed through the registration rollers 104 located on the most downstream side in the conveyance direction among the rollers driven by the conveyance motor 301.

In S502, the controller 200 determines whether or not the top sensor 105 detects the leading edge of the succeeding sheet P2, that is, the detection signal of the top sensor 105 is changed from the sheet absent state to the sheet present state. In a case where the controller 200 determines in S502 that the top sensor 105 does not detect the leading edge of the succeeding sheet P2, the processing returns to S502. In a case where the controller 200 determines in S502 that the leading edge of the succeeding sheet P2 is detected, the processing proceeds to S503. In (a) of FIG. 4A, the conveyance control unit 202 detects the leading edge of the succeeding sheet P2 by the top sensor 105 at a timing 504*t*.

In S503, the controller 200 calculates a time Tx extending from the timing 500*t* when the feeding of the succeeding sheet P2 is started until a timing (deceleration timing) 505*t* when the conveyance motor 301 is started by the calculation unit 206 of the conveyance control unit 202. Descriptions of the time Tx will be described below. In addition, the controller 200 calculates the time Ttop when the image formation on the photosensitive drum 122 of the succeeding sheet P2 is started by using the timing 500*t* for starting the feeding of the succeeding sheet P2 as a starting point by the calculation unit 206 based on the following expression (2).

$$Ttop=Tx+Tda-Ld/Vd \quad (2)$$

In S504, the controller 200 refers to the timer which is not illustrated in the drawing and determines whether or not the time has reached the deceleration timing of the conveyance motor 301, that is, the time Tx has elapsed. In a case where the controller 200 determines in S504 that the time has not reached the deceleration timing of the conveyance motor 301, the processing returns to S504. In a case where the controller 200 determines in S504 that the time has reached the deceleration timing, the processing proceeds to S505. In S505, the controller 200 returns the speed of the conveyance motor 301 to the first speed Vp1 by the driving control unit 207 of the conveyance control unit 202. The processing in S505 is equivalent to the timing 505*t* of FIG. 4A. Then, to execute the processing in S500 and subsequent steps of FIG. 3 on the next succeeding sheet P3, the flow stands by for the feeding of the succeeding sheet P3. As illustrated in FIG. 4C, when the controller 200 detects the trailing edge of the succeeding sheet P2 by the top sensor 105 at a timing 507*t*, the feeding of the next succeeding sheet P3 is started. The conveyance control on the succeeding sheet P3 is similar to the conveyance control on the succeeding sheet P2, and descriptions thereof will be omitted. It should be noted that a timing 502*t* of FIGS. 4A to 4C is a timing when the conveyance speed becomes the second speed Vp2, and a timing 506*t* is a timing when the leading edge of the succeeding sheet P2 reaches the transfer nip portion.

Deceleration Timing (the Time Tx)

With reference to FIG. 4B, a determination method for the deceleration timing of the conveyance motor 301 (the time Tx) which is executed when the leading edge of the succeeding sheet P2 is detected by the top sensor 105 will be described. FIG. 4B illustrates a change of the registration rollers 104, that is, a change of the conveyance speed of the sheet P in the conveyance motor 301. The ascending time Taa is a time used for the conveyance motor 301 to accelerate from the first speed Vp1 to the second speed Vp2, and the descending time Tda is a time used for the conveyance motor 301 to decelerate from the second speed Vp2 to the first speed Vp1. The ascending time Taa and the descending time Tda are stored in the parameter storage unit 205 of the conveyance control unit 202. A time T2 is a time when the sheet P is conveyed at the second speed Vp2, and a time T1 is a time when extending from a timing t11 (500*t*) when the trailing edge of the preceding sheet P1 is detected by the top sensor 105 until a timing t14 (506*t*) when the trailing edge of the preceding sheet P1 reaches the transfer nip portion. Herein, the time T2 needs to be determined to calculate the time Tx extending from the timing t11 when the feeding of the succeeding sheet P2 is started until a timing t13 when the deceleration of the conveyance motor 301 is started. This is because the time Tx is represented by a sum of the previously determined ascending time Taa and the time T2 (Tx=Taa+T2).

The time T1 is a time extending from the timing t11 when the feeding of the succeeding sheet P2 is started until the timing t14 when the leading edge of the succeeding sheet P2 reaches the transfer nip portion. Since the conveyance speed is accelerated from the first speed Vp1 to the second speed Vp2 during a period between the timing t11 and the timing t14, the succeeding sheet P2 can proceed farther by a distance Ln than the preceding sheet P1. In FIG. 4B, the horizontal axis represents the time, and the vertical axis represents the conveyance speed. Therefore, the areas of the respective areas illustrated in FIG. 4B represent distances.

At this time, as illustrated in FIG. 4C, it is assumed that a distance (sheet interval) from the leading edge of the succeeding sheet P2 to the trailing edge of the preceding sheet P1 is to become the distance L3 (see FIG. 4C) corresponding to the predetermined distance at the timing t14 (506*t*) when the leading edge of the succeeding sheet P2 has reached the transfer nip portion. To realize the above-described state, it is sufficient when while the trailing edge of the preceding sheet P1 proceeds by a distance (Lf+L3) from the timing 500*t* until the timing 506*t*, and the leading edge of the succeeding sheet P2 proceeds by a distance (L1+Lf) from the timing 500*t* until the timing 506*t*. Since the conveyance speed is accelerated from the first speed Vp1 to the second speed Vp2, the succeeding sheet P2 proceeds farther by a distance Ln (shaded part in FIG. 4B) than the preceding sheet P1. For this reason, the distance Ln is obtained by subtracting the distance (Lf+L3) by which the preceding sheet P proceeds from the distance (L1+Lf) by which the succeeding sheet P2 proceeds (Ln=(L1+Lf)−(Lf+L3)=(L1−L3)). As a result, it is sufficient when the succeeding sheet P2 proceeds by the distance Ln (=L1−L3) during the time T1 illustrated in FIG. 4C.

Therefore, the time T2 becomes a solution with which the area of the shaded part illustrated in FIG. 4B becomes the distance Ln. When the distance Ln is generalized, the following expression (3) is established.

$$Ln = \int_{a1}^{a2} vl(t)dt + \int_{a2}^{a3} v2(t)dt + \int_{a3}^{a4} v3(t)dt - (Lf + L3) \quad (3)$$

Where v1(*t*) indicates the conveyance speed of the succeeding sheet P2 in an interval between the timing t11 and a timing t12. In addition, v2(*t*) indicates the conveyance speed of the succeeding sheet P2 in an interval between the timing t12 and the timing t13. Furthermore, v3(*t*) indicates the conveyance speed of the succeeding sheet P2 in an interval between the timing t13 and the timing t14.

Since v1(*t*) and v3(*t*) depend on characteristics of the conveyance motor 301, v1(*t*) and v3(*t*) may be represented by not only linear functions but also high-dimensional functions such as quadratic functions in some cases. In addition, v1(*t*) and v3(*t*) may be discrete functions. For example, v1(*t*) and v3(*t*) may take variable and discrete values between 1.0 time and 1.5 times as fast as the first speed Vp1. It should be noted that the second speed Vp2 may be a fastest speed corresponding to a performance limit of the conveyance motor 301 or may be another speed. When the second speed Vp2 is set as fastest speed corresponding to the performance limit of the conveyance motor 301, the sheet interval can be set to be close to the distance L3 in a short period of time. It should be noted however that driving sound of the conveyance motor 301 becomes the loudest. In view of the above, to reduce the driving sound, the section from the feeding position of the sheet P to the position of the transfer nip portion (the section L1+Lf in terms of distance and the period T1 in terms of time) may be optimized such that the sheet interval is set to be close to the distance L3. That is, when the second speed Vp2 corresponding to a slowest limit at which the distance Ln can be shortened is selected during the time T1, the driving sound can be minimized. That is, the second speed Vp2 may be set within an allowable range of the driving sound. In this manner, the driving sound and the speed of the conveyance motor 301 have a trade-off relationship.

Herein, for convenience of the explanation, it is assumed that both an acceleration when the speed is accelerated from the first speed Vp1 to the second speed Vp2 and an acceleration when the speed is decelerated from the second speed Vp2 to the first speed Vp1 are constant. The area of the shaded part of FIG. 4B, that is, the distance Ln is calculated from the following expressions (4) to (7). First, the distance Ln is represented by the following expression (4).

$$Ln=(T1+T2)\times(Vp2-Vp1)/2 \quad (4)$$

When the time T2 is obtained by transforming the expression, the following expression (5) is obtained.

$$T2=2Ln/(Vp2-Vp1)-T1 \quad (5)$$

Since the preceding sheet P1 is moved by the distance (Lf+L3) at the first speed Vp1 during the time T1, the following expression is obtained.

$$T1=(Lf+L3)/Vp1 \quad (6)$$

At this time, when the expression (6) is assigned to the expression (5), the following expression (7) is obtained.

$$T2=2Ln/(Vp2-Vp1)-(Lf+L3)/Vp1 \quad (7)$$

It should be noted that the first speed Vp1, the second speed Vp2, and the distance Lf are already found, and those pieces of information are stored in the parameter storage unit 205.

In addition, as described above, the following expression (8) is established from FIG. 4C.

$$Ln=L1-L3 \quad (8)$$

Therefore, the distance Ln is determined from the expression (8) based on the configuration of the image forming apparatus 100. That is, it is possible to calculate the time T2 from the expression (7). It should be noted that the expression (7) can be represented as follows by using three coefficients α, β, and γ which can be obtained in advance.

$$T2=\alpha+\beta\times L3+\gamma\times L3 \quad (7')$$

It should be noted that α is determined from L1, Vp1, Vp2, and Lf, β is determined from Vp1 and Vp2, and γ is determined from Vp1. Since the transformation process from the expression (7) to the expression (7') is redundant, the descriptions thereof will be omitted.

The time T2 is equivalent to the time until the time Tx elapses in S504 of FIG. 3 (Tx=Taa+T2). Therefore, the conveyance control unit 202 determines whether or not the time T2 has elapsed from the timing t12 (502*t*) when the acceleration of the conveyance motor 301 is ended, so that it is possible to determine whether or not the time has reached the deceleration timing t13 of the conveyance motor 301. It should be noted that, in a case where the conveyance motor 301 is a pulse motor, the conveyance control unit 202 may perform management in terms of pulse while the time T2 corresponding to the rotation time is converted into the number of steps. That is, the conveyance control unit 202 counts the number of steps, and when it reaches the number of steps equivalent to the time T2, it is possible to recognize that the time has reached the timing t13 when the deceleration of the conveyance motor 301 is started.

The ascending time Taa and the descending time Tda are the times determined by the second speed Vp2, the characteristics of the conveyance motor 301 (such as characteristics of the load torque and the motor driver), and the like. Therefore, when the second speed Vp2 is determined, the ascending time Taa and the descending time Ida are also determined. It should be noted that, while a function and a table for determining the ascending time Taa and the descending time Ida from the second speed Vp2 are previously stored in the parameter storage unit 205, the calculation unit 206 reads these pieces of information to be used for the calculations.

As described above, according to the present embodiment, the section where the succeeding sheet P2 can be accelerated can be set from the start of the feeding of the succeeding sheet P2 to the transfer nip portion without adding the sensor. For this reason, in a case where the section where the acceleration can be performed without increasing the costs is extended, and the sheet interval is shortened by lengthening the section where the acceleration can be performed, it is possible to suppress the speed after the acceleration (the second speed Vp2). For this reason, without decreasing the throughput, it is possible to perform the conveyance control in which the increase in the driving sound or the lead torque of the motor is suppressed. In the above-described manner, according to the present embodiment, it is possible to reduce the operation sound or the used torque of the motor without adding the new sensor.

Second Embodiment

According to the first embodiment, the control in which the conveyance motor 301 is accelerated to shorten the sheet interval from the feeding of the succeeding sheet P2 is performed. According to the second embodiment, an example will be described in which one driving unit is used while the costs are further decreased as compared with the first embodiment. It should be noted that configurations similar to those of the first embodiment are assigned with the same reference symbols, and descriptions thereof will be omitted.

Relationships Among the Respective Rollers and Motors

Figure 5:
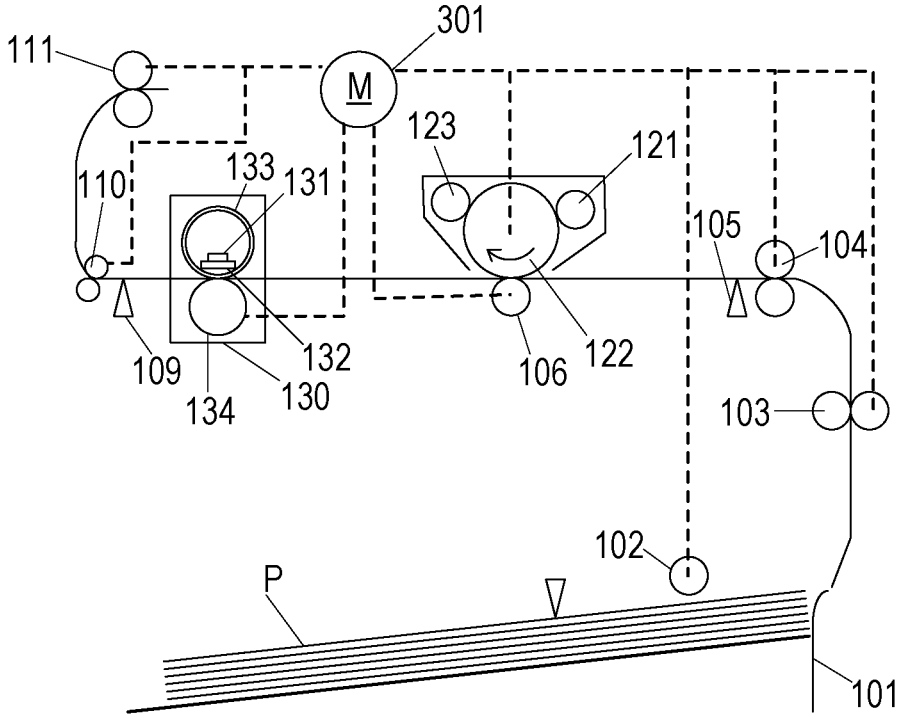
FIG. 5 illustrates relationships among the respective motors and the respective rollers according to the second embodiment.

FIG. 5 illustrates relationships among the respective rollers of the image forming apparatus 100 and the motors configured to drive the rollers according to the present embodiment. A difference from the first embodiment resides in that the entire driving of the image forming apparatus is performed by the single first driving unit (the conveyance motor 301). According to the present embodiment, both the preceding sheet P1 and the succeeding sheet P2 are conveyed by the respective rollers driven by the same conveyance motor 301. For this reason, while the toner image is transferred to the preceding sheet P1 at the transfer nip portion, when the conveyance speed of the succeeding sheet P2 is changed from the first speed Vp1 to the second speed Vp2, the transfer operation of the toner image at the transfer nip portion for the preceding sheet P1 is affected. In view of the above, according to the present embodiment, at a timing or later when the trailing edge of the preceding sheet P1 has passed through the transfer nip portion, the conveyance speed of the succeeding sheet P2 is changed.

Conveyance Control of the Sheet

Figure 6:
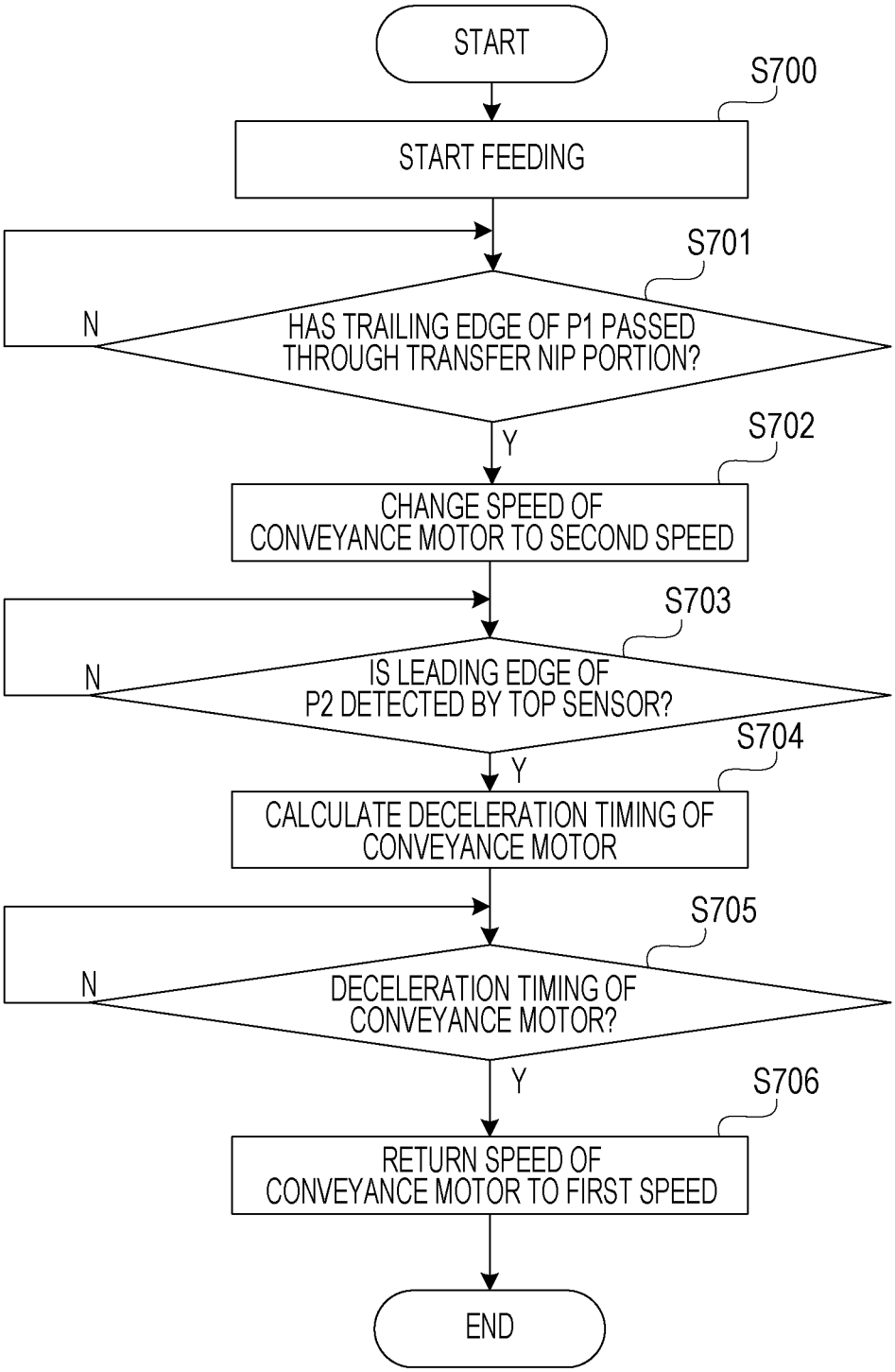
FIG. 6 is a flow chart illustrating the conveyance control according to the second embodiment.
Figure 7A:
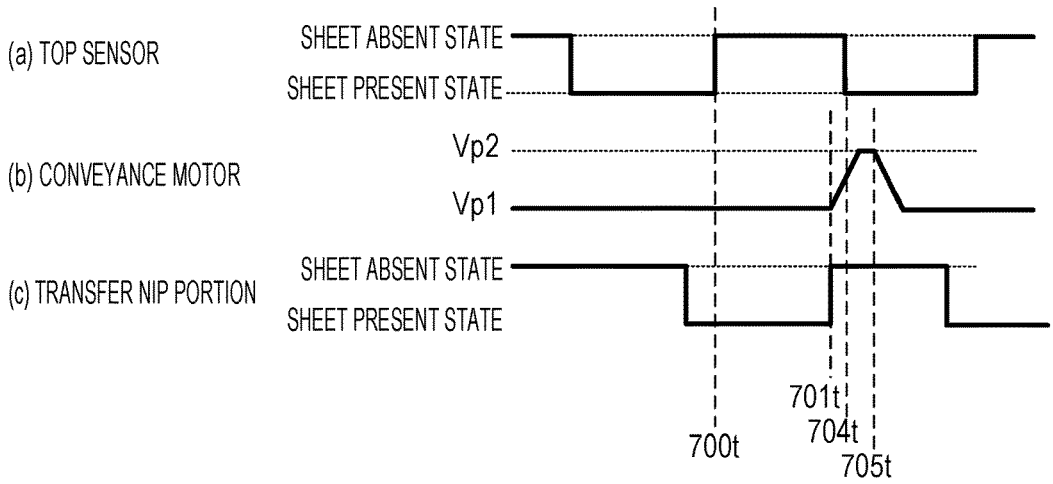
FIGS. 7A to 7C are timing charts illustrating the conveyance control according to the second embodiment.
Figure 7B:
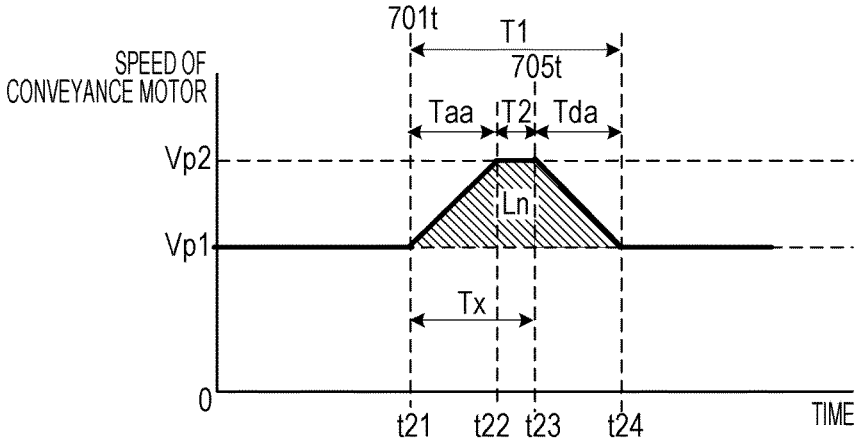
Figure 7C:
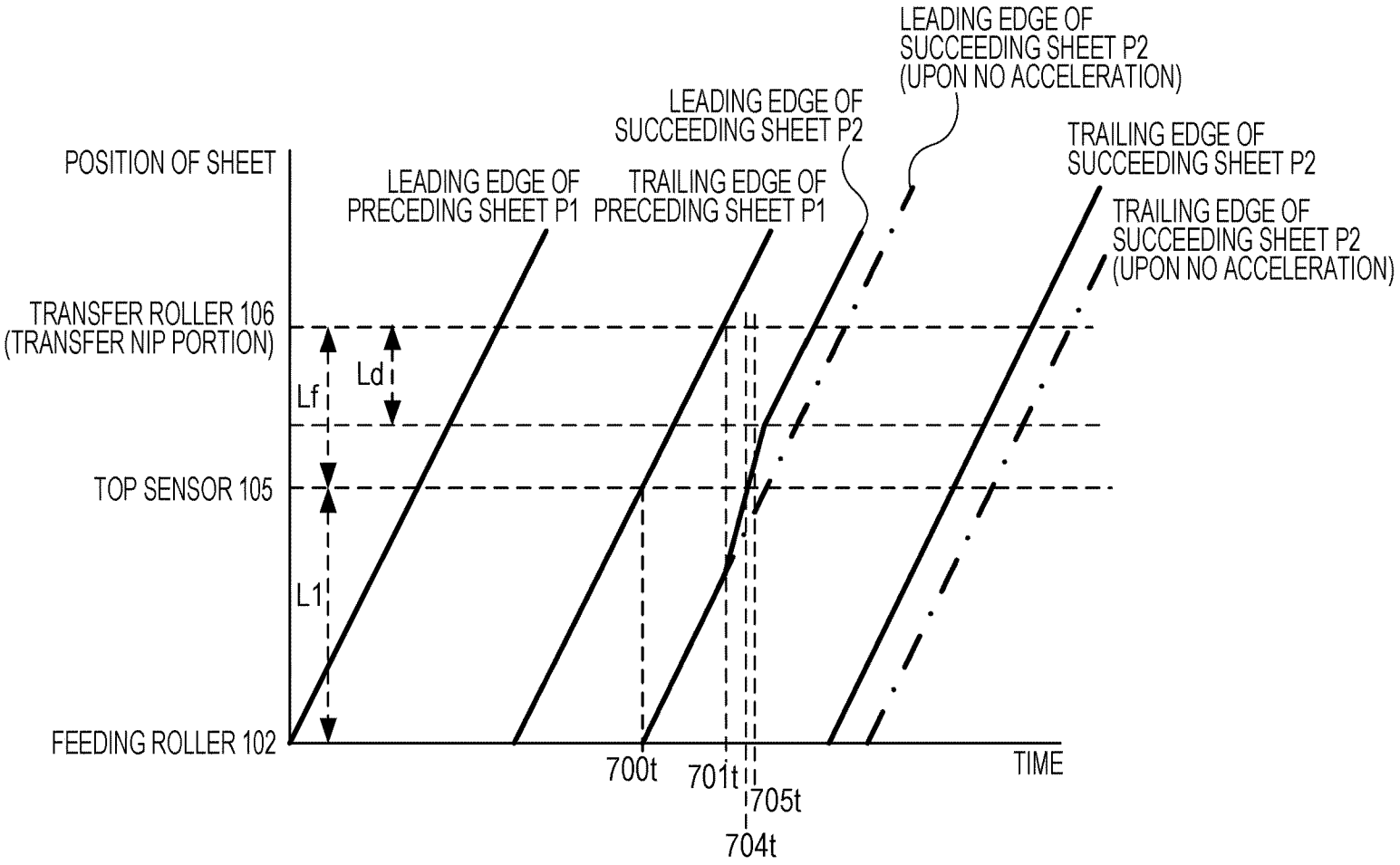

The present embodiment will be described in detail with reference to the flow chart illustrated in FIG. 6. Since FIGS. 7A to 7C are similar drawings to FIGS. 4A to 4C according to the first embodiment, the descriptions on how to view the drawings and the like will be omitted. In FIGS. 7A to 7C, a timing 700*t* is a timing when the trailing edge of the preceding sheet P1 has passed through the top sensor 105, and a timing 701*t* is a timing when the trailing edge of the preceding sheet P1 has passed through the transfer nip portion. A timing 704*t* is a timing when the leading edge of the succeeding sheet P2 has reached the top sensor 105, and a timing 705*t* is a timing when deceleration of the conveyance speed of the succeeding sheet P2 from the second speed Vp2 to the first speed Vp1 has started.

Similarly as in the first embodiment, the timing 700*t* of FIG. 7A when the trailing edge of the preceding sheet P1 is detected by the top sensor 105, the controller 200 starts the processing in S700 and subsequent steps. In S700, the controller 200 starts the feeding of the succeeding sheet P2 by the driving control unit 207. In S701, the controller 200 determines whether or not the trailing edge of the preceding sheet P1 has passed through the transfer nip portion by the conveyance control unit 202. At this time, the controller 200 determines whether or not the trailing edge of the preceding sheet P1 has passed through the transfer nip portion in the following manner. That is, the controller 200 performs the determination based on the distance (Lf) from the top sensor 105 to the transfer nip portion, the conveyance speed (Vp1) of the preceding sheet P1, a length of the preceding sheet P1 in the conveyance direction, and the like.

A reason why standby occurs until the trailing edge of the preceding sheet P1 passes through the transfer nip portion is that the single conveyance motor 301 performs the entire driving of the image forming apparatus according to the present embodiment as described above. According to the present embodiment, if the speed of the conveyance motor 301 is changed from the first speed Vp1 to the second speed Vp2 in a period during which the preceding sheet P1 passes through the transfer nip portion, a rotation speed of the photosensitive drum 122 is changed. The period during which the preceding sheet P1 passes through the transfer nip portion is a period during which the toner image on the photosensitive drum 122 is transferred to the preceding sheet P1. In this manner, there is a possibility that a difference in the speed at which the laser light performs the image formation on the photosensitive drum 122 and the speed of the rotation of the photosensitive drum 122 itself occurs and an image is disturbed. To avoid the disturbance of the image, standby occurs until the preceding sheet P1 passes through the transfer nip portion.

In a case where the controller 200 determines in S701 that the trailing edge of the preceding sheet P1 has not passed through the transfer nip portion, the processing returns to S701. In a case where the controller 200 determines in S701 that the trailing edge of the preceding sheet P1 has passed through the transfer nip portion, the processing proceeds to S702. In S702, the controller 200 changes the speed of the conveyance motor 301 from the first speed Vp1 to the second speed Vp2 by the driving control unit 207 of the conveyance control unit 202. The determination method for the second speed Vp2 may be the same as that of the first embodiment with the following exceptions.

Differences in the determination method for the second speed Vp2 from that of the first embodiment resides in that the following two aspects. First, the acceleration of the conveyance speed of the succeeding sheet P2 is not performed until the trailing edge of the preceding sheet P1 passes through the transfer nip portion. Second, the deceleration to the first speed Vp1 needs to be completed by the image formation timing on the photosensitive drum 122. For this reason, as illustrated in FIG. 7B, the time T1 according to the present embodiment is from the timing 701*t* when the trailing edge of the preceding sheet P1 leaves the transfer nip portion until the leading edge of the succeeding sheet P2 reaches the image formation timing on the photosensitive drum 122 (until the distance reaches the distance of Lf−Ld). For this reason, the time T2 when the succeeding sheet P2 can be conveyed at the second speed Vp2 is shorter than that of the first embodiment. In addition, since the restriction of the image formation timing exists, the distance L3 corresponding to the predetermined distance to be secured also is the distance Ld according to the present embodiment.

In addition, according to the present embodiment, the second speed Vp2 is changed in accordance with a sheet type. For example, in a case where the sheet type of the sheet P is thick paper (for example, a basis weight >120 g/m$^2$), conveyance force of the conveyance motor 301 has no margin, the second speed Vp2 is set to be further decreased as compared with the case of the plain paper or thin paper. That is, the second speed Vp2 is determined as a slower speed as the basis weight of the sheet P is higher. It should be noted that, in a case where the sheet type of the sheet P is not identified, a configuration may also be adopted in which the second speed Vp2 is uniformly set as a fast speed or uniformly set as a slow speed to ensure the conveyance in accordance with the conveyance force of the feeding roller 102. Since the processing in S703 is the same as the processing in S502 of FIG. 3 according to the first embodiment, and the descriptions thereof will be omitted.

In S704, the controller 200 calculates a timing when the speed of the conveyance motor 301 is switched from the second speed Vp2 to the first speed Vp1 by the driving control unit 207 of the conveyance control unit 202 (the time Tx) from the above-described expression (7') by the calculation unit 206. This timing is equivalent to the timing 704*t* of FIGS. 7A to 7C. In addition, a time Ttop2 from a timing as a starting point when the trailing edge of the preceding sheet P1 has passed through the transfer nip portion until a timing when the image formation on the photosensitive drum 122 is started to form an image on the succeeding sheet P2 is represented by the following expression (9).

$$T\text{top}2 = Tx + Tda \tag{9}$$

The processing in S705 and S706 is similar to the processing in S504 and S505 of FIG. 3, and the descriptions thereof will be omitted. It should be noted that, in FIG. 7B, a time from a timing t21 (701*t*) to a timing t22 is equivalent to the ascending time Taa, a time from a timing t22 to a timing t23 (705*t*) is equivalent to the time T2, and a time from a timing t23 to a timing t24 is equivalent to the descending time Tda.

Even in a case where the single driving unit is used as in the present embodiment, the switching from the first speed Vp1 to the second speed Vp2 is performed to change the second speed Vp2 in accordance with the sheet type of the sheet P. For this reason, the high productivity can be achieved even in a case where the driving unit is omitted for further decrease in the costs, and it is possible to execute the appropriate sheet conveyance even when the sheet type is changed. As described above, according to the present embodiment, it is possible to reduce the operation sound or the used torque of the motor without adding the new sensor.

Third Embodiment

Color Image Forming Apparatus

Figure 8A:
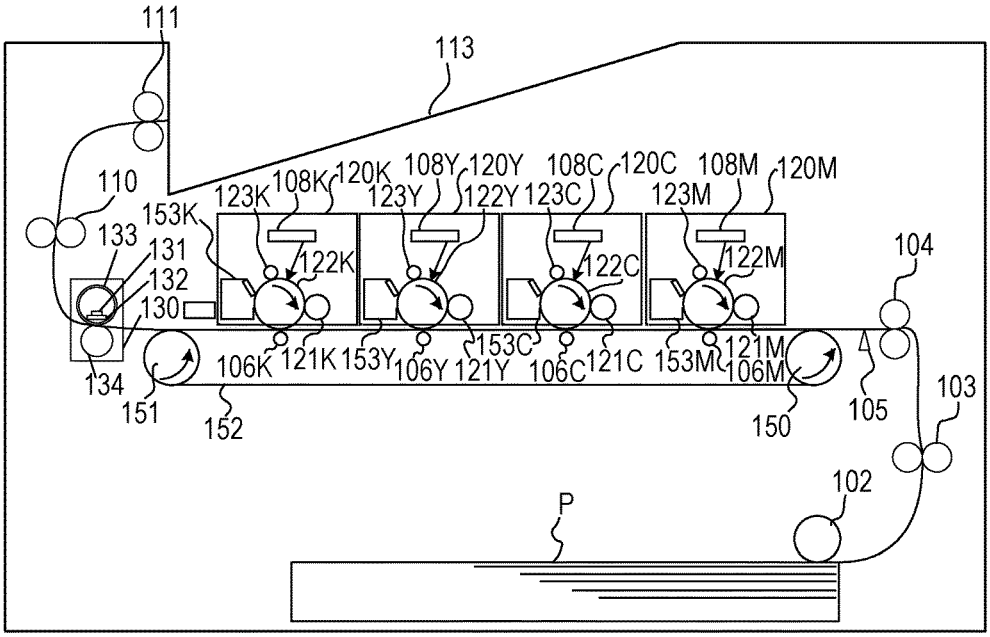
FIG. 8A illustrates the image forming apparatus according to a third embodiment.

According to the third embodiment, a case will be described where the configuration is applied to a color image forming apparatus. FIG. 8A is a schematic configuration of the image forming apparatus according to the present embodiment. Photosensitive drums 122M, 122C, 122Y, and 122K are provided for process cartridges 120M, 120C, 120Y, and 120K respectively provided with developer (toner) of magenta, cyan, yellow, and black while both ends of the respective photosensitive drums are supported so as to be rotatable. Herein, subscripts M, C, Y, and K which represent the colors are omitted unless when necessary. The photosensitive drum 122 receives driving transmission from one of the ends by a driving motor which is not illustrated in the drawing and a driving transmission unit and is driven to be rotated in a clockwise direction (arrow direction) in the drawing. The respective photosensitive drums 122 coated with organic photoconductive layers on the surfaces are uniformly charged on the surfaces when the charging rollers 123 are applied with charging voltages. The photosensitive drum 122 is selectively exposed with light by the laser light emitted from the optical box 108, and the electrostatic latent image is formed. The electrostatic latent image formed on the photosensitive drum 122 is developed as the toner image while the toner of each color is adhered by the development roller 121.

The sheets P are stacked in the sheet cassette, and the sheet P is fed by the feeding roller 102 driven at a predetermined timing by a conveyance motor 901 functioning as a second driving unit which will be described below and a driving transmission unit which is not illustrated in the drawing. The sheet P fed by the feeding roller 102 is conveyed by a transfer conveyance belt 152 functioning as a belt conveyance unit via the conveyance rollers 103 and the registration rollers 104. The transfer conveyance belt 152 is supported by a driving roller 150 functioning as a rotating unit and a driven roller 151. The transfer conveyance belt 152 is a belt-like member that is nipped between the plurality of photosensitive drums 122 and the plurality of transfer roller 106 and conveys the sheet P. The transfer conveyance belt 152 is driven so as to rotate in an anticlockwise direction in the drawing when the driving roller 150 rotates while being contacted with the photosensitive drum 122 by a development roller 902 (see FIG. 8B) functioning as the first driving unit and the driving transmission unit which is not illustrated in the drawing.

The transfer rollers 106 functioning as transfer units with respect to the sheet P are respectively applied with predetermined transfer voltages, and the toner images of the respective colors on the photosensitive drum 122 are transferred to the sheet P conveyed by the transfer conveyance belt 152, so that the toner images of the four colors are formed. The toner remaining on the photosensitive drum 122 is removed by a cleaner 153. The sheet P on which the toner images of the four colors are transferred is conveyed to the fixing apparatus 130, and the toner images are fused and fixed by heat and pressure onto the sheet P, so that the color image is obtained. The configuration of the fixing apparatus 130 is similar to the configuration described with reference to FIG. 1A, and the descriptions thereof will be omitted. The sheet P conveyed by the fixing apparatus 130 is discharged to the tray 113 via the rollers 110 and 111 and stacked. The image forming apparatus 100 according to the present embodiment also is provided with the top sensor 105.

Relationships Among the Respective Rollers and Motors

Figure 8B:
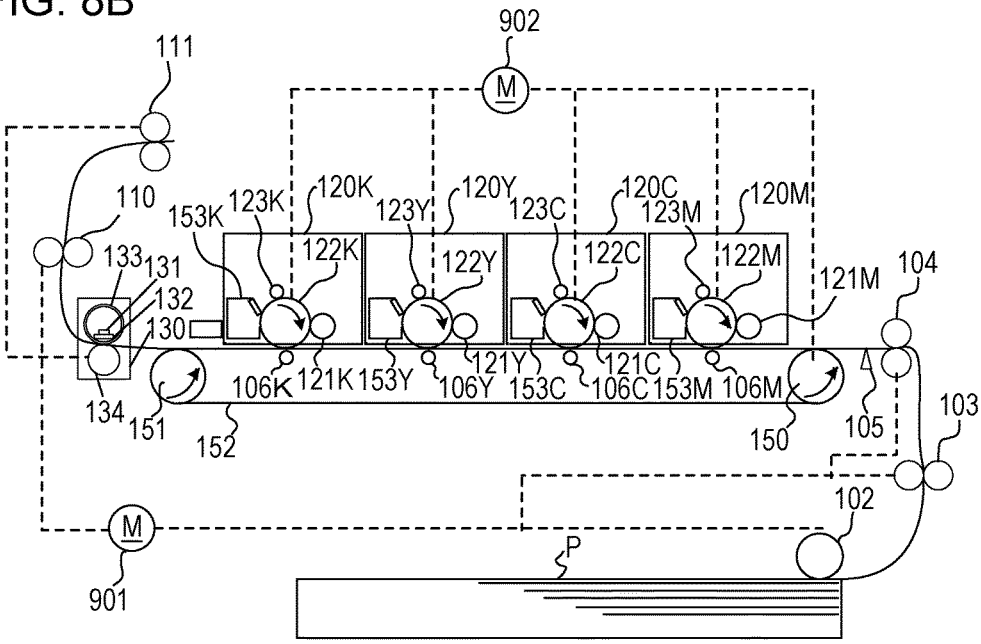
FIG. 8B illustrates the relationships among the respective rollers and the respective motors.

FIG. 8B illustrates relationships among the respective rollers of the image forming apparatus 100 and the motors configured to drive the rollers. The conveyance motor 901 and the development roller 902 are used in the image forming apparatus 100. The conveyance motor 901 drives the feeding roller 102, the conveyance rollers 103, the pressurizing roller 134, the roller 110, the roller 111, and the registration rollers 104. The conveyance motor 901 functions as a driving unit configured to drive a plurality of conveyance units that are not involved in the image formation. The development roller 902 drives the photosensitive drums 122M, 122C, 122Y, 122K and the transfer conveyance belt 152 (the driving roller 150).

Distance Relationships Among the Members on the Conveyance Path

Figure 9:
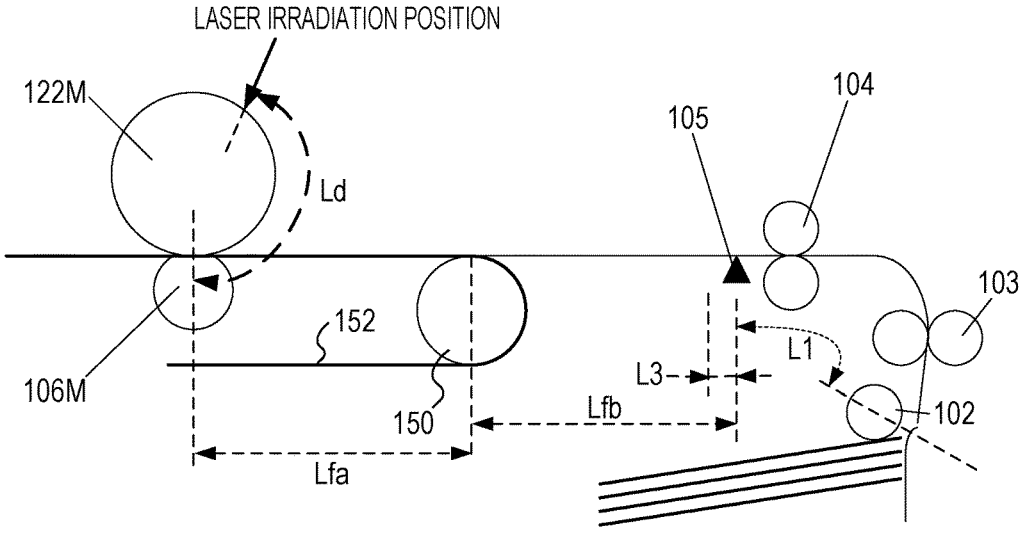
FIG. 9 illustrates the relationship among the members on the conveyance path according to the third embodiment.

FIG. 9 illustrates distance relationships among the members on the conveyance path. According to the present embodiment, the number of transfer nip portions corresponding to the number of colors (four) are provided, and the driving roller 150 is located between the transfer nip portion of magenta located in the most upstream side in the conveyance direction of the sheet P among the transfer nip portions for the number of colors and the registration rollers 104. Herein, a distance between the transfer nip portion of magenta and the driving roller 150 is set as Lfa, and a distance between the driving roller 150 and the top sensor 105 is set as Lfb. A difference from the first embodiment resides in that the distance Lf is changed depending on the positional relationships among the photosensitive drums 122M, the driving roller 150 and the registration rollers 104.

Conveyance Control of the Sheet

Figure 10:
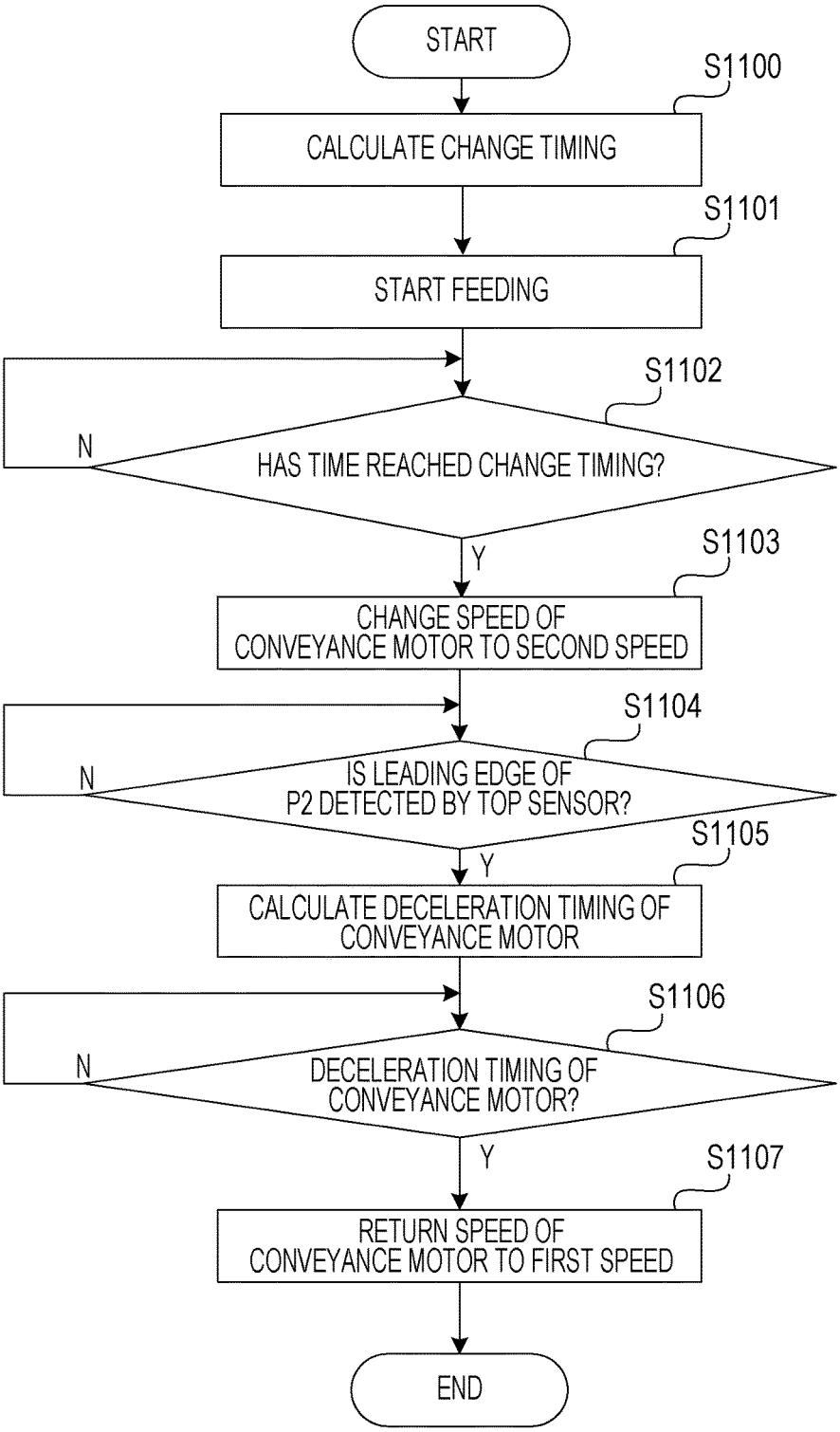
FIG. 10 is a flow chart illustrating the conveyance control according to the third embodiment.

FIG. 10 is a flow chart for describing the conveyance control of the sheet P according to the present embodiment. Similarly as in the first embodiment, when the trailing edge of the preceding sheet P1 is detected by the top sensor 105, the controller 200 starts the processing in S1100 and subsequent steps. In S1100, the controller 200 calculates a timing when the speed of the conveyance motor 901 for conveying the succeeding sheet P2 by the driving control unit 207 of the conveyance control unit 202 is changed from the first speed Vp1 to the second speed Vp2 (hereinafter, which will be referred to as a change timing). The change timing calculated in S1100 is determined in accordance with the sheet type of the succeeding sheet P2. For example, in a case where the sheet type of the succeeding sheet P2 is thin paper having a predetermined basis weight (for example, the basis weight <120 g/m$^2$), since the conveyance force used for the conveyance is low, the acceleration is started when the feeding of the succeeding sheet P2 is started. On the other hand, in a case where the sheet type of the succeeding sheet P2 is thick paper having a basis weight higher than the predetermined basis weight (for example, the basis weight 120 g/m$^2$), the conveyance force used for the conveyance is high. For this reason, in order that the succeeding sheet P2 can be conveyed by the plurality of rollers, after the succeeding sheet P2 is fed, the acceleration is started at a timing when the leading edge of the succeeding sheet P2 has reached the conveyance rollers 103. It should be noted that, in a case where the sheet type of the succeeding sheet P2 is not found, the acceleration may be uniformly started at the start of the feeding or when the leading edge of the succeeding sheet P2 has reached the conveyance rollers 103 in accordance with the conveyance force of the feeding roller 102.

In S1101, the controller 200 starts the feeding of the succeeding sheet P2 by the driving control unit 207 of the conveyance control unit 202 and resets the timer which is not illustrated in the drawing to start. In S1102, the controller 200 determines whether or not the time has reached the change timing calculated in S1100 by referring to the timer. In a case where the controller 200 determines in S1102 that the time has not reached the change timing, the processing returns to S1102. In a case where the controller 200 determines in S1102 that the time has reached the change timing, the processing proceeds to S1103. For example, in a case where it is determined that the succeeding sheet P2 is the thin paper, the time has reached the change timing along with the feeding. On the other hand, in a case where the succeeding sheet P2 is the thick paper, it is determined that the time has reached the change timing when the leading edge of the succeeding sheet P2 has reached the conveyance rollers 103. Whether or not the leading edge of the succeeding sheet P2 has reached the conveyance rollers 103 is determined based on a distance between the feeding roller 102 and the conveyance rollers 103 along the conveyance path and the conveyance speed of the succeeding sheet P2 (Vp1). In S1103, the controller 200 changes the speed of the conveyance motor 901 from the first speed Vp1 to the second speed Vp2. Since the processing in S1104 is the same as the processing in S502 of FIG. 3 described according to the first embodiment, the descriptions thereof will be omitted.

In S1105, the controller 200 calculates the deceleration timing (the time Tx) of the conveyance motor 901 by the calculation unit 206 of the conveyance control unit 202. In the calculation of the deceleration timing executed when the leading edge of the succeeding sheet P2 is detected by the top sensor 105, the deceleration timing (the time Tx) of the conveyance motor 901 can be calculated by using the above-described expression (7'). Herein, according to the present embodiment, the distance Lf in the expression (7') varies in accordance with a relationship between the distance Lfa illustrated in FIG. 9 and the distance Ld corresponding to the distance in accordance with the timing for starting the image formation. In detail, the distance Lf in the expression (7') varies in the case of Lfa≤Ld and the case of Lfa<Ld. Lf=Lfb is established in the case of Lfa≥Ld, and Lf=Lfb−(Ld−Lfa) is established in the case of Lfa<Ld.

In addition, when the leading edge of the succeeding sheet P2 is detected by the top sensor 105, a time Ttop3 when the image formation on the photosensitive drum 122 is started is calculated from the following expression (10). It should be noted that, at this time, Ttop3 is calculated by using a timing when the acceleration of the conveyance speed of the succeeding sheet P2 from the first speed Vp1 to the second speed Vp2 is started as a starting point.

In the case of (Lfa≥Ld), $$Ttop3=Tx+Ida+(Lfa-Ld)/Vd, \text{ and}$$

in the case of (Lfa<Ld), $$Ttop3=Tx+Ida \tag{10}$$

The processing in S1106 and S1107 is similar to the processing in S504 and S505 of FIG. 3 described according to the first embodiment, and the descriptions thereof will be omitted.

In the above-described manner, according to the present embodiment, in the case of the color image forming apparatus, the speed of the conveyance motor 901 is switched from the first speed Vp1 to the second speed Vp2, and the timing for changing the speed to the second speed Vp2 can be varied in accordance with the sheet type of the succeeding sheet P2. For this reason, the high productivity also can be achieved in the color image forming apparatus, and the appropriate sheet conveyance can be executed even when the sheet type of the sheet P is changed. As described above, according to the present embodiment, it is possible to reduce the operation sound or the used torque of the motor without adding the new sensor.

While the present invention has been described with reference to embodiments, it is to be understood that the invention is not limited to the disclosed embodiments. The scope of the following claims is to be accorded the broadest interpretation so as to encompass all such modifications and equivalent structures and functions.

This application claims the benefit of Japanese Patent Application No. 2016-095269 filed May 11, 2016, which is hereby incorporated by reference herein in its entirety.

What is claimed is:

1. An image forming apparatus comprising:

an image bearing member;

a transfer unit configured to form a nip portion together with the image bearing member and to transfer a toner image formed on the image bearing member to a recording material in the nip portion;

a feeding unit configured to feed a recording material stacked in an accommodation portion to a conveyance path;

a conveyance unit that is arranged along the conveyance path and configured to convey the recording material fed by the feeding unit;

a first driving unit configured to drive the feeding unit and the conveyance unit;

a detection unit that is arranged between the conveyance unit and the transfer unit and configured to detect the recording material; and a control unit configured to perform control, in a manner that image formation to the image bearing member is started based on a timing, when a leading edge of the recording material is detected by the detection unit, wherein the control unit changes a conveyance speed of a first recording material from a first speed to a second speed, that is faster than the first speed, before a leading edge of the first recording material fed by the feeding unit is detected by the detection unit to perform conveyance by the conveyance unit, controls the first driving unit in a manner that the conveyance speed of the first recording material is changed from the second speed to the first speed before the leading edge of the first recording material reaches the nip portion based on a timing when the leading edge of the first recording material is detected by the detection unit, and obtains a timing for the image formation to the image bearing member based on a timing when the conveyance speed is changed from the second speed to the first speed, and wherein the control unit calculates the timing when the conveyance speed is changed from the second speed to the first speed in a manner that a distance between a trailing edge of a second recording material and the leading edge of the first recording material is set as a predetermined distance, wherein the second recording material is a recording material that is fed before the first recording material, and the second recording material and the first recording material are fed continuously.

2. The image forming apparatus according to claim 1, further comprising a second driving unit that is different from the first driving unit and configured to drive the image bearing member and the transfer unit, wherein the control unit controls the first driving unit in a manner that the feeding of the first recording material by the feeding unit is started and also the conveyance speed is changed from the first speed to the second speed and controls the second driving unit to set the conveyance speed as the first speed.

3. The image forming apparatus according to claim 1, wherein the detection unit is arranged between a conveyance unit located on a most downstream side in a conveyance direction of the recording material among the conveyance units and the transfer unit, and wherein the control unit feeds the first recording material by the feeding unit after the trailing edge of the second recording material passes through the detection unit.

4. The image forming apparatus according to claim 1, wherein the first driving unit drives the image bearing member and the transfer unit, and wherein the control unit controls the first driving unit in a manner that the conveyance speed is changed from the first speed to the second speed after the trailing edge of the second recording material passes through the nip portion.

5. The image forming apparatus according to claim 1, wherein the second speed is determined in accordance with a sheet type of the recording material.

6. The image forming apparatus according to claim 5, wherein the second speed is determined as a slower speed as a basis weight of the recording material is higher.

* * * * *